US008710988B1

(12) United States Patent
Foster

(10) Patent No.: US 8,710,988 B1
(45) Date of Patent: Apr. 29, 2014

(54) METHOD FOR DETECTING MOTION OF AN ELECTRICAL DEVICE OR APPARATUS

(76) Inventor: William Lee Foster, Hayfork, CA (US)

( * ) Notice: Subject to any disclaimer, the term of this patent is extended or adjusted under 35 U.S.C. 154(b) by 207 days.

(21) Appl. No.: 13/136,867

(22) Filed: Aug. 11, 2011

(51) Int. Cl.
*G08B 13/12* (2006.01)
*G08B 13/14* (2006.01)

(52) U.S. Cl.
USPC ..... 340/568.3; 340/568.1; 340/568.2; 340/687

(58) Field of Classification Search
USPC ..... 340/568.1–568.3, 686.1, 686.2, 686.4, 340/687
See application file for complete search history.

(56) References Cited

U.S. PATENT DOCUMENTS 4,284,983 A * 8/1981 Lent ..... 340/522
5,418,521 A * 5/1995 Read ..... 340/568.3
6,337,633 B1 * 1/2002 Foseide ..... 340/687
7,053,774 B2 * 5/2006 Sedon et al. ..... 340/568.2
7,667,601 B2 * 2/2010 Rabinowitz et al. ..... 340/568.2
8,348,695 B2 * 1/2013 Puzio et al. ..... 439/449
8,395,907 B2 * 3/2013 Marszalek et al. ..... 361/807
2009/0033492 A1 * 2/2009 Rapp et al. ..... 340/568.8

* cited by examiner

*Primary Examiner* — Steven Lim
*Assistant Examiner* — Ryan Sherwin
(74) *Attorney, Agent, or Firm* — Risto A. Rinne, Jr.

(57) ABSTRACT

A method for providing an alert to a person to unplug an electrical power cord of an electrical device or equipment includes an alarm device that is activated upon separation of a first portion from a second portion. The first and second portions of the alarm device are secured proximate opposite sides of a loop provided in the power cord. The first and second portions, when engaged, maintain a switch of an electrical circuit in an open position. If the equipment is moved prior to unplugging the power cord, the loop will be straightened, causing the first and second portions to separate. The switch closes, completing the electrical circuit and activating the alarm device. The alarm alerts the person to unplug the power cord. A first alternate method includes the alarm device as a part of newly manufactured equipment. A second alternate method includes a motion detector or sensor in the alarm device of the newly manufactured equipment. A third alternate method includes an add-on alarm device with the motion detector or sensor.

17 Claims, 4 Drawing Sheets

METHOD FOR DETECTING MOTION OF AN ELECTRICAL DEVICE OR APPARATUS

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to alerts and alarm systems and, more particularly, to a method for providing an alarm to prevent inadvertent unplugging of a power cord attached to an electrical device, apparatus or equipment.

Hospitals, doctor and medical office buildings use a wide variety of electrical devices and monitoring equipment that requires electrical power to function. The word "equipment" as used herein is meant to include any type of an electrical device or an apparatus that includes an electrical power cord that is plugged into a standard 120-VAC (or other voltage) electrical duplex outlet to receive the electrical power. Some equipment of this type may also include a back-up battery for use during power failures or when away from a duplex outlet. However, the back-up battery must periodically be charged by electricity using the power cord.

At times, there may only be one particular type of equipment (i.e., blood pressure monitor) or limited quantities available for use at the hospital, medical building, or doctor's office. These types of equipment are usually equipped with wheels or kept on a cart for easy transportation from room to room. As there is likely more patients than available equipment, medical staff must share the same piece of equipment for use with numerous patients.

Due to a sense of urgency present at most medical facilities, remembering proper procedure for transporting the equipment may be difficult. Nursing and medical staff may be rushing to tend to the needs of a patient and have those needs on their mind. It is easy to forget that the piece of equipment that they need is plugged in to a power outlet.

In addition, other similar situations can occur at facilities not related to the medical industry. Various other types of electrical devices and equipment require connection to a 120-VAC power outlet for operation. At times, the equipment may need to be transported from one location to another location. Even if a person is not rushing or in a hurry, it may be easy to forget to unplug the equipment prior to transport.

As mentioned previously, the desired equipment (or device) is equipped with wheels or kept on a cart. As the staff member is likely very busy, there is potential risk of not unplugging the power cord prior to moving the equipment. If the power cord remains plugged into the power outlet as the equipment is being moved to a new location, tension provided by the moving equipment or cart may cause damage to the power cord or outlet.

In worst-case scenarios, the power cord may stay plugged into the outlet and act as a leash. Tension provided by the power cord can abruptly stop the moving equipment and cause the equipment to fall over. Severe damage to the equipment can occur. If the equipment is sitting on top of a cart, the entire cart may tip over and the equipment can fall off the cart and be severely damaged.

Alarm systems are well-known ways of providing alerts to individuals to get their attention. The alert may be for notifying staff members if a patient has fallen out of their bed or wheelchair. They can also range from emergency alerts for notifying staff of particular needs of a patient to providing an alarm as part of a home security system.

However, there has not yet been an effective method to alert a person to unplug a piece of equipment prior to its transport.

Accordingly, there exists today a need for a method for detecting motion of an electrical device or apparatus that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such a method for detecting motion of an electrical device or apparatus would be useful and desirable.

2. Description of Prior Art

Alarm systems, in general, are known.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a method for detecting motion of an electrical device or apparatus that provides an audible alert to help prevent damage from occurring to a power cord, an AC electrical outlet, or equipment when the power cord is connected to the AC electrical outlet and the equipment is moved.

It is also an important object of the invention to provide a method for detecting motion of an electrical device or apparatus that provides a visible alert to help prevent damage from occurring to a power cord, an AC electrical outlet, or equipment when the power cord is connected to the AC electrical outlet and the equipment is moved.

Another object of the invention is to provide a method for detecting motion of an electrical device or apparatus that helps to prevent damage from occurring to an electrical power cord.

Still another object of the invention is to provide a method for detecting motion of an electrical device or apparatus that helps to prevent damage from occurring to the electrical device.

Still yet another object of the invention is to provide a method for detecting motion of an electrical device or apparatus that includes an alarm device that is secured by any preferred means to an electrical power cord of a piece of equipment.

Yet another important object of the invention is to provide a method for detecting motion of an electrical device or apparatus that includes an alarm device that includes a first portion that is attached to a first location on an electrical power cord of a piece of equipment.

Still yet another important object of the invention is to provide a method for detecting motion of an electrical device or apparatus that includes an alarm device that includes a first portion that is attached to a first location wherein the first location is disposed proximate a loop of an electrical power cord of a piece of equipment.

A first continuing object of the invention is to provide a method for detecting motion of an electrical device or apparatus that includes an alarm device that includes a second portion that is attached to a second location on an electrical power cord of a piece of equipment.

A second continuing object of the invention is to provide a method for detecting motion of an electrical device or apparatus that includes an alarm device that includes a second portion that is attached to a second location wherein the second location is disposed proximate a loop of an electrical power cord of a piece of equipment.

A third continuing object of the invention is to provide a method for detecting motion of an electrical device or apparatus that includes an alarm device that includes a second portion that is attached to a second location wherein the second location is attached to a piece of equipment.

A fourth continuing object of the invention is to provide a method for detecting motion of an electrical device or apparatus that includes an alarm device that activates the alarm if a first portion of the alarm device is separated apart from a second portion of the alarm device.

A fifth continuing object of the invention is to provide a method for detecting motion of an electrical device or apparatus that includes a first portion of an alarm device that cooperatively engages with a second portion of the alarm device.

A sixth continuing object of the invention is to provide a method for detecting motion of an electrical device or apparatus that includes a magnetic means of securing a first portion to a second portion of an alarm device.

A seventh continuing object of the invention is to provide a method for detecting motion of an electrical device or apparatus that includes a first portion of an alarm device that includes a magnet and a second portion of an alarm device that includes a steel plate wherein when the magnet and the steel plate are placed in proximity to each other the first portion and the second portion are secured together.

An eighth continuing object of the invention is to provide a method for detecting motion of an electrical device or apparatus that includes an alarm device that is included as a part of a newly manufactured piece of equipment.

A ninth continuing object of the invention is to provide a method for detecting motion of an electrical device or apparatus that includes an alarm device that can be attached to existing equipment.

A tenth continuing object of the invention is to provide a method for detecting motion of an electrical device or apparatus that includes an alarm device that can be attached to a power cord of existing equipment.

An eleventh continuing object of the invention is to provide a method for detecting motion of an electrical device or apparatus that includes an alarm device that is supplied power by a battery.

A twelfth continuing object of the invention is to provide a method for detecting motion of an electrical device or apparatus that includes an electrical circuit and a proximity or other type of switch in an interior of an alarm device wherein the circuit is activated when a first portion of the alarm device is separated from a second portion of the alarm device.

A thirteenth continuing object of the invention is to provide a method for detecting motion of an electrical device or apparatus that activates an alarm when a switch closes an electrical circuit.

A fourteenth continuing object of the invention is to provide a method for detecting motion of an electrical device or apparatus that does not provide an alarm when a first portion of an alarm device is cooperatively engaged with a second portion of the alarm device.

A fifteenth continuing object of the invention is to provide a method for detecting motion of an electrical device or apparatus that includes a magnetic proximity switch.

A sixteenth continuing object of the invention is to provide a method for detecting motion of an electrical device or apparatus that provides an alarm indication when the electrical device that is connected to an electrical outlet is moved.

A seventeenth continuing object of the invention is to provide a method for detecting motion of an electrical device or apparatus that provides an alarm indication when attempting to move the electrical device before disconnecting the device from an electrical outlet.

Briefly, a method for detecting motion of an electrical device or apparatus that is constructed in accordance with the principles of the present invention has an alarm device that is activated upon separation of a first portion with respect to a second portion of the alarm device. The first portion and the second portion are detachably-attachable with respect to each other. The first portion and the second portions of the alarm device are secured by any preferred means proximate each other and are disposed between opposite sides of a loop created along a longitudinal length of an electrical power cord. The electrical power cord is attached to any type of an electrical device, an apparatus or equipment at a first end, thereof. A second end of the electrical power cord includes a plug that is inserted into a standard 120-VAC duplex power outlet (or other voltage) to provide power to the equipment. The first portion of the alarm device is secured at a first location proximate the loop of the electrical power cord. The second portion of the alarm device is secured proximate the loop at a second location. The second location is located a predetermined distance away from the first location on the opposite side of the loop of the electrical power cord. The first location may also include a predetermined location disposed on the equipment. The first and second portions are attached to the electrical power cord by attachment cords, located on opposite ends of the first and second portions. A clip or any other preferred means hold the attachment cords onto the electrical power cord. After the first and second portions are secured to the electrical power cord, the first and second portions of the alarm device are cooperatively engaged. To maintain engagement, a protrusion can be provided on the second portion that is inserted into a recess provided on the first portion. As another means for engagement, a magnet is provided on the first portion (or, alternately, the second portion) and a steel plate is provided on the second portion (or the first portion). A proximity or a normally closed type of switch is attached to a first contact located on an electrical circuit.

The magnet used for engagement may also be used to activate the proximity switch, if desired. Both the electrical circuit and switch are housed in a main interior of the first portion of the alarm device. Once the first and second portions are engaged, the switch is held in an open position. The protrusion, if included on the second portion, enters the recess and provides pressure against the switch to keep the switch in the open position. The protrusion or magnet maintains the switch in the open position when the first portion and the second portion are cooperatively engaged with one-another. A spring can be used to provide tension to urge the switch in a closed position when the first and second portions are separated. While the switch remains in the open position (i.e., when the first and second portions are engaged), the electrical circuit is not complete (i.e., open). When the equipment is moved in a direction away from the power outlet prior to an unplugging of the electrical power cord, tension is created along the longitudinal length of the electrical power cord as it straightens. The loop will begin to straighten to a more linear orientation. As the loop straightens, the tension provided along the electrical power cord disengages the first portion from the second portion of the alarm device. Upon a separation of the first and second portions (i.e., removal of the protrusion from the recess or of the magnet), the spring urges the switch into the closed position. The switch connects with a second contact, which in turn, completes the electrical circuit. If the magnetic proximity switch is included, a magnetic field provided by the magnet is removed and the magnetic proximity switch similarly closes. Completion of the electrical circuit activates an audible or a visual alarm (or both an audible and visual alarm) disposed along a path of the electrical circuit. The alarm alerts a person moving the equipment to stop moving the equipment and to unplug the electrical power cord from the outlet before continuing to move the equipment any further. The alarm is in a silent non-active quiescent state (i.e., not activated) when the first and second portions are engaged. A battery located in an interior compartment in the main interior of the alarm device supplies power to the alarm. A first alternate method includes the alarm device being included as a part of newly manufactured equipment. The battery is not needed to supply power to the alarm device if the alarm device is included as part of the newly manufactured equipment. The newly manufactured equipment supplies power to activate the alarm device. However, if desired, the battery may still be included in the alarm device. A second alternate method includes any desired type of a motion detector (or sensor) being included within the newly manufactured equipment. The motion detector may include any type of a vibration detector or a g-force detector. Interior circuitry and/or a microcomputer monitors if the equipment is connected to the power outlet. If the motion detector detects motion of the equipment while the equipment is connected to the power outlet, the alarm will sound and/or be visible until the equipment is unplugged from the power outlet. An optional reset button may be included on the equipment that is pressed to silence or deactivate the alarm. A third alternate method includes an add-on alarm device that is attached by any preferred means to the equipment. The equipment may be newly manufactured or pre-existing. The add-on alarm device includes the motion detector (or sensor) and if desired, the reset button. The electrical power cord of the equipment is plugged directly into an outlet provided on the add-on alarm device. The add-on alarm device includes a secondary electrical power cord that is plugged into the power outlet to receive electrical power and convey the electrical power to the equipment. The add-on alarm device monitors for electrical power being supplied to the equipment and monitors motion of the equipment. If the equipment is moved while electrical power is being supplied through the secondary electrical power cord, the alarm will sound and/or be visible until the secondary electrical power cord is unplugged from the power outlet or the reset button on the add-on alarm device is pressed.

DETAILED DESCRIPTION OF THE INVENTION

Figure 1:
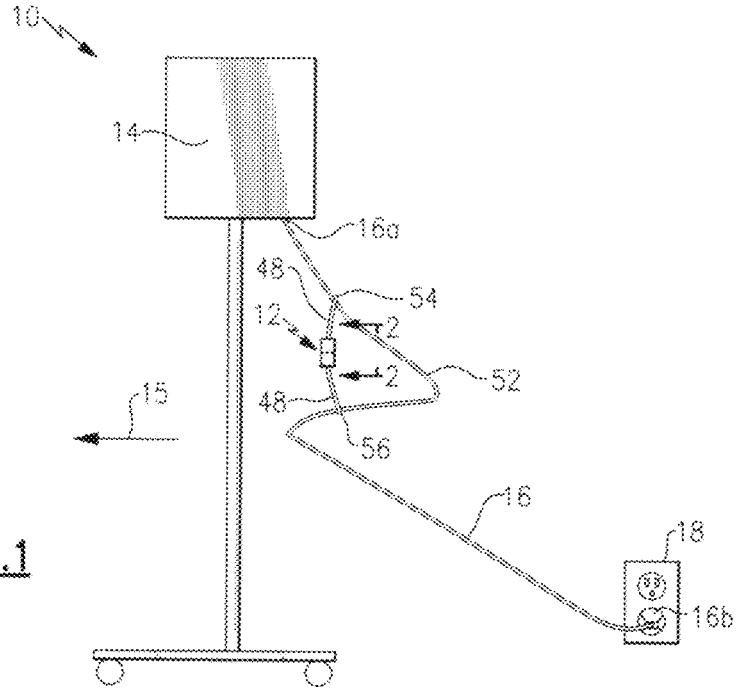
FIG. 1 is an elevational view of a method for detecting motion of an electrical device or apparatus with a strain relief alarm attached to an electrical power cord of a piece of equipment and the power cord attached to an electrical outlet.
Figure 3:
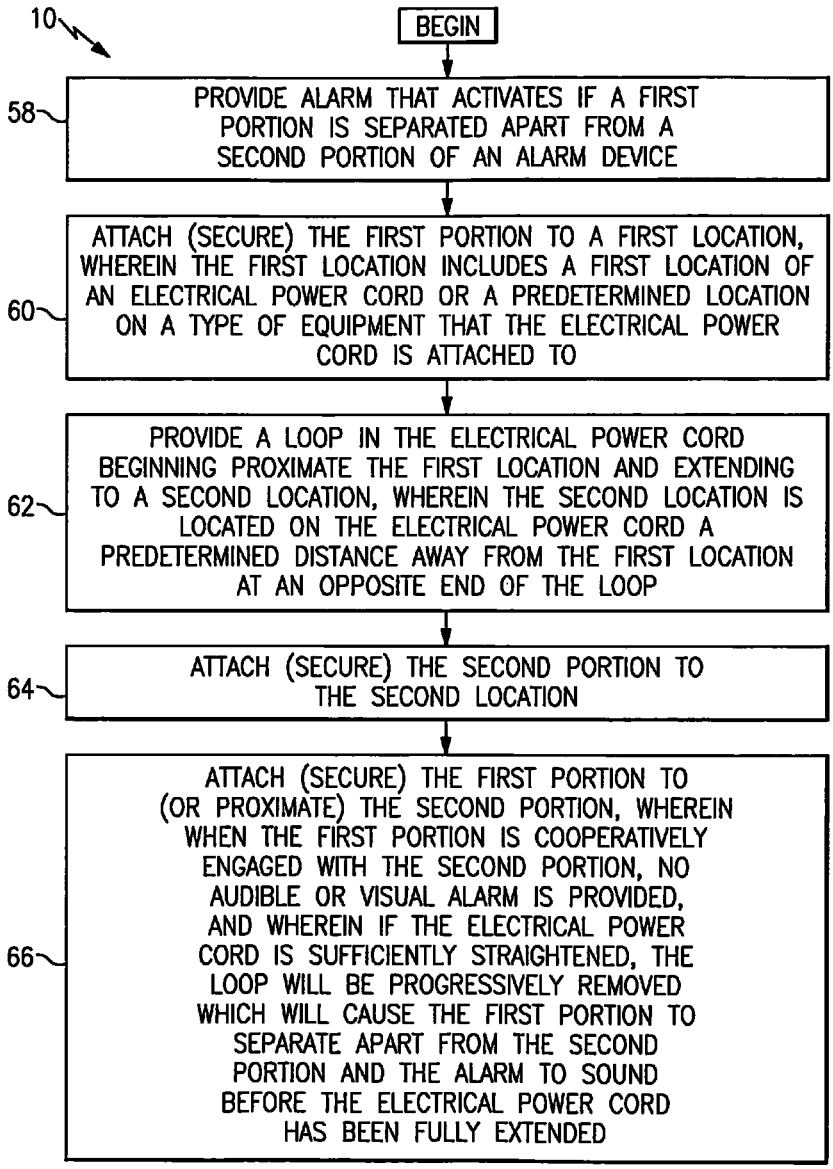
FIG. 3 is a flow chart of the method for detecting motion of a electrical device or apparatus of FIG. 1.

Referring on occasion to all of the FIGURE drawings and now, in particular to FIGS. 1 and 3, is shown a method for detecting motion of an electrical device or apparatus, identified in general, by the reference numeral 10. All of the drawing figures illustrate a device for detecting motion (i.e., a strain relief alarm or a motion detector) and it's intended method for use.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The method for detecting motion of an electrical device or apparatus 10 includes an alarm device, identified in general by reference numeral 12. The alarm device 12 is shown in a rectangular shape but any preferred shape such as an "egg-like" oval shape, as shown in FIG. 4, may be included. The alarm device 12 includes a thin plastic housing 12*a*, which can include any preferred color. Operation of the alarm device 12 will be described in greater detail, hereinafter.

The alarm device 12 is used to provide notification to a medical staff member (or other person, not shown) that is transporting a type of equipment 14 (i.e., blood pressure monitor or other monitoring equipment) from one location to another. The staff member may be rushed in their duties and proper procedure for the transportation of the equipment 14 may easily be overlooked.

The equipment 14 may be in high demand if only a limited quantity of that particular type of equipment 14 is available. This can also occur for non-medical electrical equipment. If the equipment 14 is located at a hospital, multiple patients (not shown) located in different hospital rooms may share use of the same piece of equipment 14.

The equipment 14 includes an electrical power cord 16 to receive electricity to power operation of the equipment 14. A first end 16*a* of the electrical power cord 16 is directly attached to the equipment 14. A plug 16*b* is included on an opposite second end of the electrical power cord 16. The plug 16*b* is inserted into a standard duplex receptacle 120-VAC power outlet 18 to supply electrical power to the equipment 14.

As previously mentioned, the staff member is likely to be very busy. There is exists potential risk of the staff member not remembering to unplug the plug 16*b* of the electrical power cord 16 from the outlet 18 prior to moving the equipment 14 to a different location (i.e., different hospital room).

The alarm device 12 used with the method for detecting motion of an electrical device or apparatus 10 serves as a reminder to alert the staff member to unplug the electrical power cord 16 from the outlet 18 prior to further movement of the equipment 14.

The method for detecting motion of an electrical device or apparatus 10 used to alert the staff member to remove the plug 16*b* from the outlet 18 provides an important benefit. The method for detecting motion of an electrical device or apparatus 10 prevents severe and expensive damage from occurring to the either the equipment 14, or damage to the electrical power cord 16 or the outlet 18 should the staff member forget to unplug the equipment 14 prior to transport.

If the staff member continues pulling the equipment 14 away from the outlet 18, as shown by arrow 15, the electrical power cord 16 can serve as a leash and hold the equipment 14 in place. The equipment 14 will be held in place by the electrical power cord 16, which quickly stops a portion of the equipment 14 from continuing to move in the direction of arrow 15. However, inertia can continue motion of another portion of the equipment 14 in the direction of arrow 15.

For example, when the end of the electrical power cord 16 is suddenly reached, an upper portion of the equipment 14 where the electrical power cord 16 is attached, can stop moving in the direction of arrow 15. However, a lower portion of the equipment 14 (i.e., where the castor's are located) is apt to continue its motion in the direction of arrow 15. This can result in an imbalance, which may cause the equipment 14 to fall to the floor. The equipment 14 may be damaged or broken, which may then need to be repaired or replaced at considerable cost. The falling equipment 14 may even injure the staff member, the patient, or others in proximity of the equipment 14.

Figure 2:
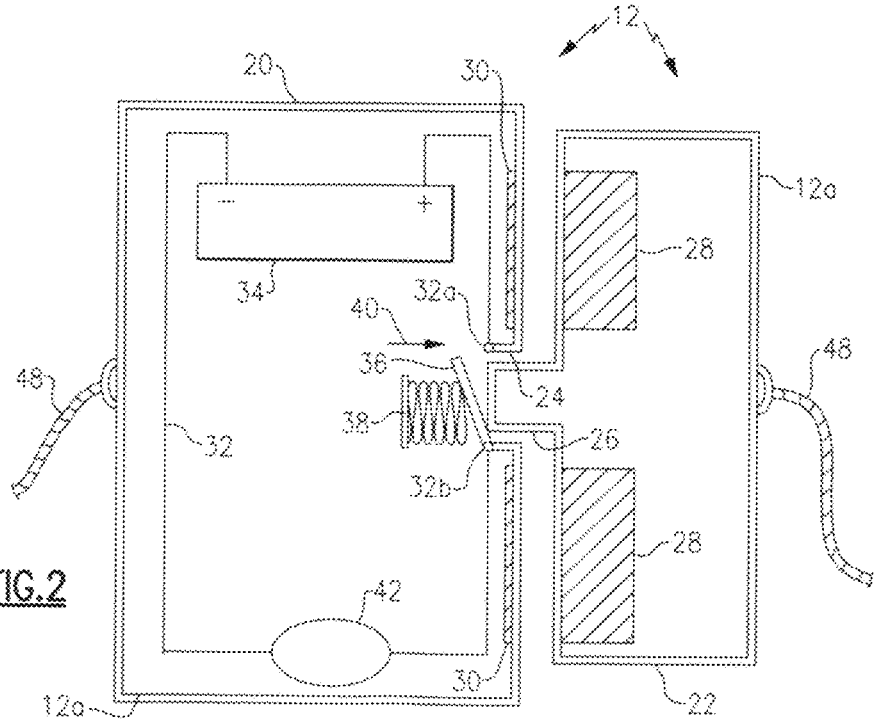
FIG. 2 is a cross-sectional view taken on the line 2-2 in FIG. 1 of the strain relief alarm.

Referring now in particular to FIG. 2, is shown an interior of the alarm device 12 taken along line 2-2 of FIG. 1.

The alarm device 12 includes a first portion 20 and a second portion 22. The first portion 20, according to a first embodiment, includes a recess 24. The recess 24 receives a protrusion 26 that is included on the second portion 22.

The protrusion 26 enters and cooperatively engages with the recess 24 to help secure the first portion 20 to the second portion 22.

A pair of magnets 28 may also be included in the first portion 20 or in the second portion 22 as another possible means for securing the first portion 20 to the second portion 22. The pair of magnets 28 engage with a pair of steel plates 30 that are disposed in an interior of the opposite portion (20, 22).

Also included in the interior of the first portion 20 is an electrical circuit 32. A first end of the electrical circuit 32 terminates at a first contact 32*a*, and an opposite second end of the electrical circuit 32 terminates at a second contact 32*b*. As shown, the first contact 32*a* and the second contact 32*b* are located on opposite sides of the recess 24. Electrical power is supplied to the electrical circuit 32 from a battery 34 that is housed within a compartment located on the first portion 20.

A normally closed switch 36 is disposed between the first contact 32*a* and the second contact 32*b*. The switch 36 controls the flow of electrical power supplied to the electrical circuit 32. If the switch 36 is disposed in an open position, as shown in FIG. 2, the electrical circuit 32 is not complete and the alarm device 12 is not activated.

The protrusion 26 of the second portion 22 pushes against a lower portion of the switch 36 and positions an upper portion of the switch 36 away from the first contact 32*a*. A spring 38 located proximate the switch 36 provides tension against the switch 36. The spring 38 supplies a force that attempts to urge the switch 36 into a normally closed position. The protrusion 26 prevents the switch 36 from being closed. Accordingly, the protrusion 26 holds the switch 36 in the open position. As previously mentioned above, while the switch 36 is in the open position, the electrical circuit 32 is not complete.

Once the protrusion 26 has been removed from the recess 24, the spring 38 is able to urge the switch 36 against the first contact 32*a*, as shown by arrow 40, and into the normally closed position. The switch 36 connects with the first contact 32*a* to complete the electrical circuit 32.

Electrical power supplied from the battery 34 is able to traverse through the electrical circuit 32 to activate an alarm 42. The alarm 42 is disposed along the path of the electrical circuit 32. The alarm 42 includes any desired audible or visual indication or both.

Accordingly, whenever the second portion 22 is urged away from (i.e., out of cooperative engagement with) the first portion 20, the alarm 42 is activated. To silence (i.e., stop) the alarm 42, the second portion 22 must be disposed adjacent to the first portion 20 and cooperatively engaged (i.e., properly oriented) with the first portion 20.

The pair of magnets 28 in addition to helping secure the first portion 20 to the second portion 22 can also be used to control activation of a normally closed magnetic proximity switch (type well known in the alarm industry, not shown). If the proximity switch is included, it replaces the switch 36. The proximity switch is controlled by a magnetic field generated by the magnet(s) 28 in the second portion 22.

The magnets 28, when proximate the proximity switch, retain a switch contact inside the proximity switch in an open position. Therefore, the electrical circuit 32 is not complete and the alarm 42 is silent. When the second portion 22 is urged away from the first portion 20 the magnetic field that holds the proximity switch in the open position is removed. The proximity switch closes, thereby completing the electrical circuit 32 and activating the alarm 42 until the second portion 22 is adjacent to the first portion 20.

Figure 4A:
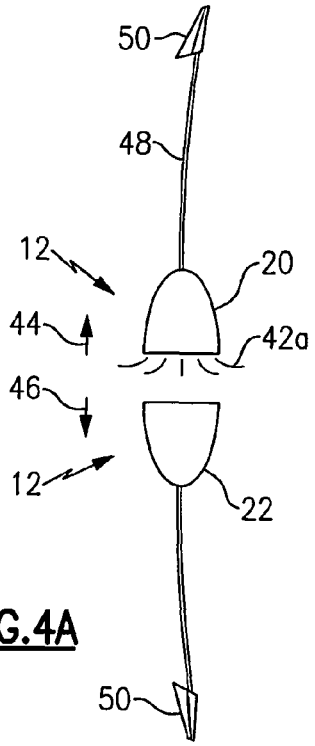
FIG. 4*a* is a side view of the strain relief alarm of FIG. 1 shown in an active state
Figure 4B:
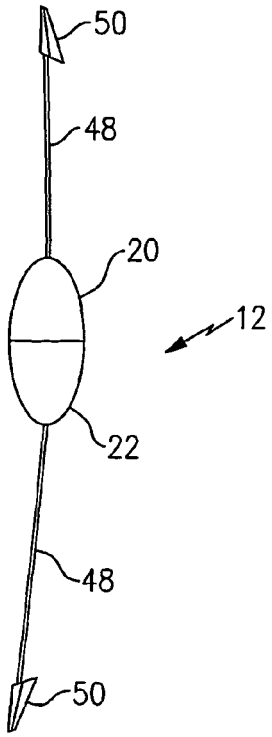
FIG. 4*b* is a side view of the strain relief alarm of FIG. 1 shown in an inactive state.

Referring momentarily to FIGS. 4*a* and 4*b*, is shown the alarm device 12 in both an active (FIG. 4*a*) and a quiescent non-active state (FIG. 4*b*).

In the quiescent non-active state as shown in FIG. 4*b*, the first portion 20 and the second portion 22 of the alarm device 12 are engaged. The alarm 42 is silent. To engage the first portion 20 with the second portion 22, the protrusion 26 is placed into the recess 24. Or, alternately if included, the alarm 42 is silenced by placing the pair of magnets 28 located in the second portion 22 adjacent to the steel plate 30 that is located in the first portion 20.

The alarm 42 is not activated (i.e., silent) while the first portion 20 and the second portion 22 are engaged. Upon disengagement of the first portion 20 with respect to the second portion 22, as shown by arrows 44 and 46 (FIG. 4*a*), the alarm 42 will be activated. The alarm 42 will produce an alarm sound 42*a*, or if preferred, the alarm 42 may also include an activation of a light to provide the visible indication of the alarm 42.

The alarm sound 42*a* will continue to be present until the first portion 20 and the second portion 22 are again cooperatively engaged.

The first portion 20 and the second portion 22 include an attachment cord 48 on either side, thereof. Each opposite end of the attachment cord 48 includes a clip 50, which allows the first and second portions 20, 22 to be attached to the electrical power cord 16 of the equipment 14. If preferred, one or both of the clips 50 may be omitted and the attachment cord 48 can be attached to the electrical power cord 16 by any other preferred means (i.e., tying a knot, or use of a hook and loop fastener, or by use of tape).

The first portion 20 of the alarm device 12 is secured by the clip 50 proximate a loop 52 (See FIG. 1) provided in the electrical power cord 16. As used herein, the term "loop" refers to an area of the electrical power cord 16 that includes an area of slack. The slack forms a curved portion, as shown. The loop 52 does not need to form a complete circle. The clip 50 is placed at a first location 54 along a longitudinal length of the electrical power cord 16 proximate the loop 52. If desired, the first location 54 may also be a predetermined location disposed on the equipment 14 (See FIG. 5).

The second portion 22 of the alarm device 12 is secured proximate the loop 52 at a second location 56 by the clip 50. The second location 56 is located a predetermined distance away from the first location 54 on the electrical power cord 16.

When the equipment 14 is moved prior to removal of the plug 16*b* of the electrical power cord 16 from the outlet 18, tension is applied along the longitudinal length of the electrical power cord 16.

As the equipment 14 is being moved in the direction of arrow 15, the tension applied to the electrical power cord 16 will begin to straighten the loop 52 to a more linear orientation.

As the loop 52 straightens to a longer, and more linear orientation, a distance between the first location 54 and second location 56 increases. The increased distance between the first location 54 and second location 56 on the electrical power cord 16 pulls on each of the attachment cords 48. Once the attachment cords 48 are taught, the tension supplied disengages the first portion 20 from the second portion 22 of the alarm device 12.

Upon a separation of the first and second portions 20, 22 (i.e., removal of the protrusion 26 from the recess 24 or the magnets 28 away from the proximity switch), the alarm 42 is activated. The alarm 42 produces the alarm sound 42*a* and provides an alert to the staff member. The staff member (or person) ceases moving the equipment 14 and is reminded to remove the plug 16*b* from the outlet 18 before continuing to move the equipment 14 any further.

Now referring to FIG. 3, is shown a flow chart of the method for detecting motion of an electrical device or apparatus 10.

A first method step 58 is to provide the alarm 42 that activates if the first portion 20 is separated apart from the second portion 22 of the alarm device 12.

A second method step 60 is to attach (i.e., secure) the first portion 20 to the first location 54, wherein the first location 54 includes a first location of the electrical power cord 16 or a predetermined location on a type of equipment 14 that the electrical power cord 16 is attached to.

A third method step 62 is to provide the loop 52 in the electrical power cord 16 beginning proximate the first location 54 and extending to the second location 56, wherein the second location 56 is located on the electrical power cord 16 a predetermined distance away from the first location 54 at an opposite end of the loop 52.

A fourth method step 64 is to attach (i.e., secure) the second portion 22 to the second location 56.

A fifth method step 66 is to attach (i.e., secure) the first portion 20 to (or proximate) the second portion 22, wherein when the first portion 20 is cooperatively engaged with the second portion 22, no audible or visual alarm 42 is provided, and wherein if the electrical power cord 16 is sufficiently straightened, the loop 52 will be progressively removed which will cause the first portion 20 to separate apart from the second portion 22 and the alarm 42 to sound 42*a* before the electrical power cord 16 has been fully extended.

Figure 5:
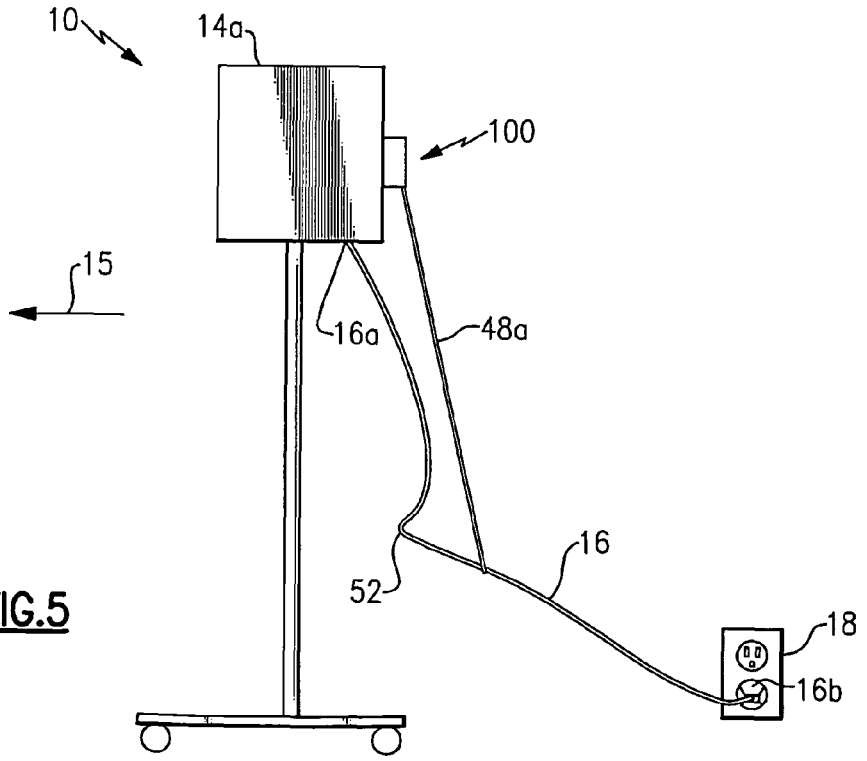
FIG. 5 is a first modified embodiment of providing the method for detecting motion of an electrical device or apparatus of FIG. 1 attached to a newly manufactured equipment.

Referring now to FIG. 5, is shown a first modified alarm device, identified in general by the reference numeral 100. The modified alarm device 100 may also be included with the method for detecting motion of an electrical device or apparatus 10.

The modified alarm device 100 is included as a part of a newly manufactured equipment 14*a*. The modified alarm device 100 operates similar to the alarm device 12.

The modified alarm device 100 is detachably-attachable with respect to a portion of the newly manufactured equipment 14*a*.

The electrical circuit 32 and the switch 36 (or the magnetic proximity switch) are included in an interior of the newly manufactured equipment 14*a*. Operation of the electrical circuit 32 is identical as to what has been previously described for the alarm device 12.

Power supplied to the electrical circuit 32 may be supplied by electricity from the newly manufactured equipment 14*a* or, if desired, the battery 34 may be included in an interior compartment (not shown) of the modified alarm device 100.

A modified attachment cord 48*a* extends from the modified alarm device 100 and attaches to the electrical power cord 16 at an opposite end of the loop 52. The clip 50, or any other preferred means of attachment, may be used for securing the modified alarm device 100 to the electrical power cord 16.

As the newly manufactured equipment 14*a* is moved away from the outlet 18 in the direction of arrow 15, the modified attachment cord 48*a* is pulled taught. Tension provided by the moving newly manufactured equipment 14*a* removes the modified alarm device 100 from the portion of the newly manufactured equipment 14*a* before the loop 52 has been fully extended and the end of the electrical power cord 16 has been reached.

The removal of the modified alarm device 100 triggers activation of the alarm 42. The staff member (or person) is then reminded to unplug the plug 16*b* from the outlet 18. The alarm 42 will continue to sound 42*a* until the modified alarm device 100 is again engaged with the newly manufactured equipment 14*a*.

Figure 6:
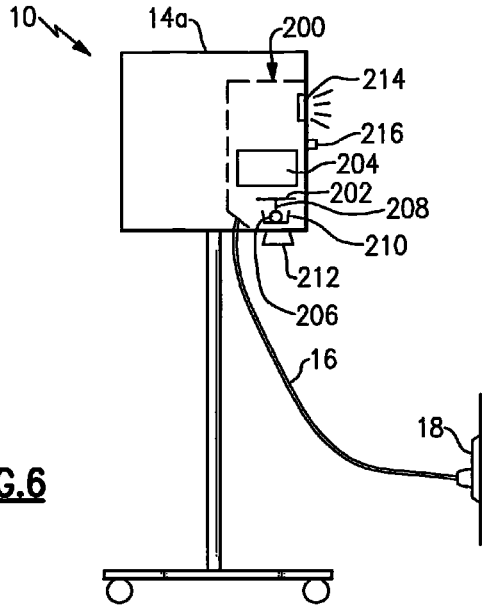
FIG. 6 is a second modified embodiment of providing the method for detecting motion of an electrical device or apparatus of FIG. 1 including a motion detector located in an interior of a newly manufactured equipment.

Referring now to FIG. 6, is shown a second modified alarm device (dashed lines), identified in general by the reference numeral 200. The second modified alarm device 200 provides an alternate method or means for detecting motion of an electrical device or apparatus 10 relative to the ground surface upon which it is disposed. In particular, a change in motion from stationary (i.e., being at rest or static) to being moved is what is being detected.

The modified alarm device 200 is included in an interior of the newly manufactured equipment 14*a*. The second modified alarm device 200 includes a motion detector 202 and a microcomputer 204. The motion detector 202 and the microcomputer 204 are located in an interior of the second modified alarm device 200.

The microcomputer 204 and/or any other preferred type of circuitry monitors if the electrical power cord 16 of newly manufactured equipment 14*a* is plugged into the outlet 18. Whenever the newly manufactured equipment 14*a* is plugged into the outlet 18, the second modified alarm device 200 is active.

The motion detector 202 includes a ball 206 suspended from a pendulum 208. This variation is one indication on how to provide a vibration or g-force detector for the motion detector 202. The motion detector 202 may also include a conventional motion sensor such as infrared (IR) or other technology.

If the newly manufactured equipment 14*a* is moved, the ball 206 and pendulum 208 swings toward a conducting ring 210, which closely surrounds the ball 206. Both the ball 206 and the pendulum 208 are electrically charged. As the ball 206 makes contact with the conducting ring 210, a circuit is completed and the second modified alarm device 200 is activated.

If desired, a motion sensor 212 may be included on a bottom panel of the newly manufactured equipment 14*a* instead of the motion detector 202. The motion sensor 212 monitors a ground surface (not shown) disposed below the newly manufactured equipment 14*a*. If the motion sensor 212 detects movement of the newly manufactured equipment 14*a* relative to the ground surface, the second modified alarm device 200 is activated.

It is preferred that the second modified alarm device 200 is electrically latched when activated, although it does not have to be latched. It is additionally preferred that the second modified alarm device 200 will continue to sound from a speaker 214 until the newly manufactured equipment 14*a* is unplugged from the outlet 18.

When the newly manufactured equipment 14*a* is unplugged from the outlet 18, electrical power is removed from the newly manufactured equipment 14*a*. The alarm provided through the speaker 214 is silenced as no electrical power is present in the second modified alarm device 200. Even if battery backup power is available, the second modified alarm device 200 will silence the alarm when the electrical power cord 16 is unplugged from the outlet 18.

If desired, a reset button 216 may be included on the newly manufactured equipment 14*a* to silence the second modified alarm device 200 instead of unplugging the electrical power cord 16 from the outlet 18.

Figure 7:
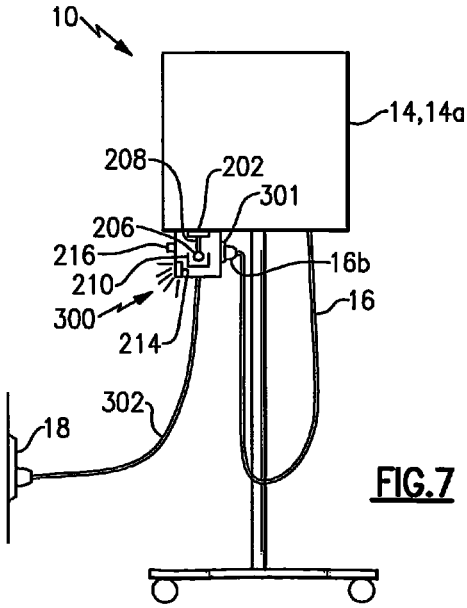
FIG. 7 is a third modified embodiment of providing the method for detecting motion of an electrical device or apparatus of FIG. 1 including an add-on alarm device attached to the equipment.

Referring now to FIG. 7, is shown a third modified alarm device, identified in general by the reference numeral 300. The third modified alarm device 300 provides another alternate method (or means) for detecting motion of an electrical device or apparatus 10.

The third modified alarm device 300 is an add-on device that is attached to the equipment 14 by any preferred means including VELCRO™, an adhesive, or the third modified alarm device 300 may be screwed in place to the equipment 14.

The third modified alarm device 300 includes an integral outlet 301 that the plug 16*b* of the electrical power cord 16 of the equipment 14 (or the newly manufactured equipment 14*a*) is plugged into. The third modified alarm device 300 includes a secondary electrical power cord 302 which is plugged into the outlet 18 to receive electrical power.

The third modified alarm device 300 operates similarly to the second modified alarm device 200. The motion detector 202 is included in an interior of the third modified alarm device 300.

It is noted that any current or future technology that can be used to detect motion of the equipment 14 or the newly manufactured equipment 14*a* is possible for use as the motion detector 202 and is included in the scope of the invention.

As mentioned previously, the motion detector 202 includes the ball 206 and the pendulum 208. When the equipment 14, 14*a* is moved, the ball 206 and pendulum 208 swings toward the conducting ring 210, which closely surrounds the ball 206. Both the ball 206 and the pendulum 208 are electrically charged. As the ball 206 makes contact with the conducting ring 210, a circuit is completed and the third modified alarm device 300 is activated.

The third modified alarm device 300 produces an alarm sound that is provided through the speaker 214 that is attached to the third modified alarm device 300.

When the secondary electrical power cord 302 is unplugged from the outlet 18, electrical power is removed from the equipment 14, 14*a*. The alarm provided through the speaker 214 is silenced as no electrical power is present in the third modified alarm device 300 or is silenced even if battery backup is available for the third modified alarm device 300.

If desired, the reset button 216 may be included on the third modified alarm device 300 to silence the alarm instead of unplugging the secondary electrical power cord 302 from the outlet 18.

The third modified alarm device 300 allows retrofitting of this technology and method to any existing or currently manufactured type of the equipment 14, 14*a*.

Other methods of detecting motion of the equipment 14, 14*a* are also possible for inclusion with the method for detecting motion of an electrical device or apparatus 10. For example, circuitry to detect a very slight increase in tension between the electrical power cord 16 and the equipment 14, 14*a* may be used to detect initial movement of the equipment 14, 14*a*. The movement of a spring or other component can also be used to detect movement or vibration of the equipment 14, 14*a*. When the stationary equipment 14, 14*a* is moved, the inertia and the state of equilibrium of the equipment 14, 14*a* are changed and any means for detecting that change are possible for inclusion with the method for detecting motion of an electrical device or apparatus 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for detecting motion of an electrical device or apparatus, comprised of the steps of:

(a) providing an alarm device that activates an audible or visible or audible and visible alarm when a first portion of said alarm device is urged at least a minimum predetermined distance away from a second portion of said alarm device;

(b) securing said first portion to a first location, wherein said first location includes a first location of an electrical power cord or a predetermined location on a type of equipment that said electrical power cord is attached to;

(c) providing a loop in said electrical power cord, wherein a first end of said loop originates at or proximate to said first location of said electrical power cord;

(d) securing said second portion to a second location, wherein said second location includes a second location of said electrical power cord, and wherein said second location of said electrical power cord is disposed at or proximate to a second end of said loop, and wherein said second end of said loop is disposed a predetermined distance away from said first end of said loop;

(e) securing said first portion adjacent to said second portion, wherein said first portion is cooperatively engaged with said second portion, and wherein when said first portion is cooperatively engaged with said second portion no audible or visible alarm is provided; and (f) including a first tether attached to said first portion, and wherein said first tether includes a first end of said first tether and an opposite distal second end of said first tether, and wherein said first end of said first tether is attached to said first portion, and wherein said step of securing said first portion to said first location includes the step of securing said second end of said first tether to said first location of said electrical power cord;

and wherein when said electrical power cord is straightened a sufficient amount, said loop is progressively removed, and wherein when said loop has been progressively removed a sufficient amount, said first portion is urged out of said cooperative engagement with said second portion and said audible alarm or said visible alarm, or both said audible alarm and said visible alarm, are activated.

2. The method for detecting motion of an electrical device or apparatus of claim 1 including the step of including a second tether attached to said second portion, and wherein said second tether includes a first end of said second tether and an opposite distal second end of said second tether, and wherein said first end of said second tether is attached to said second portion, and wherein said step of securing said second portion to said second location includes the step of securing said second end of said second tether to said second location of said electrical power cord.

3. The method for detecting motion of an electrical device or apparatus of claim 2 wherein the step of securing said second end of said second tether to said second location of said electrical power cord includes the step of including a clip attached to said second end of said second tether and securing said clip to said second location of said electrical power cord.

4. The method for detecting motion of an electrical device or apparatus of claim 2 wherein the step of securing said second end of said second tether to said second location of said electrical power cord includes the step of tying said second end of said second tether to said second location of said electrical power cord.

5. The method for detecting motion of an electrical device or apparatus of claim 1 including the step of including a tether with said second portion, and wherein said tether includes a first end of said tether and an opposite distal second end of said tether, and wherein said first end of said tether is attached to said second portion, and wherein said step of securing said second portion to said second location includes the step of securing said second end of said tether to said second location of said electrical power cord.

6. The method for detecting motion of an electrical device or apparatus of claim 1 including the step of completing an electrical circuit in said first portion when said electrical power cord is straightened said sufficient amount, and wherein when said electrical circuit is completed the method for detecting motion of an electrical device or apparatus includes the step of activating said alarm device.

7. The method for detecting motion of an electrical device or apparatus of claim 6 wherein said step of activating said alarm device includes the step of activating said alarm device for a duration of time that said first portion is not in said cooperative engagement with said second portion.

8. The method for detecting motion of an electrical device or apparatus of claim 7 including the step of restoring said first portion into said cooperative engagement with said second portion, and wherein when said first portion is restored into said cooperative engagement with said second portion, said method includes the step of not activating said alarm device.

9. The method for detecting motion of an electrical device or apparatus of claim 1 wherein the step of securing said second end of said first tether to said first location of said electrical power cord includes the step of including a clip attached to said second end of said first tether and securing said clip to said first location of said electrical power cord.

10. The method for detecting motion of an electrical device or apparatus of claim 1 wherein the step of securing said second end of said first tether to said first location of said electrical power cord includes the step of tying said second end of said first tether to said first location of said electrical power cord.

11. The method for detecting motion of an electrical device or apparatus of claim 1 wherein said step of securing said first portion to said first location, wherein said first location includes a predetermined location of a type of equipment that said electrical power cord is attached to includes the step of attaching said first portion to said equipment as an integral component of said equipment.

12. The method for detecting motion of an electrical device or apparatus of claim 11 wherein said step of attaching said first portion to said equipment as an integral component of said equipment includes the step of including said first portion inside of an enclosure of said equipment.

13. A method for detecting a change in motion of an electrical device or apparatus, comprised of the steps of:

(a) providing an alarm device that activates an audible or visible or audible and visible alarm when said alarm device receives an activation signal;

(b) providing means for detecting a change in motion of said electrical device or apparatus, and wherein subject to the detection of a change in motion of said electrical device or apparatus by said means for detecting a change in motion of said electrical device or apparatus when an electrical power cord of said electrical device or apparatus is connected to a source of electrical power, said means for detecting a change in motion of said electrical device or apparatus supplies said activation signal to said alarm device, including the step of housing said alarm device and said means for detecting a change in motion of said electrical device or apparatus in an enclosure and of securing or attaching said enclosure to said electrical device or apparatus, and including the step of including a secondary electrical power cord attached to said enclosure and including an integral electrical outlet that is attached to said enclosure.

14. The method of claim 13 wherein the step of providing an alarm device includes providing an alarm device that is attached to or disposed inside of said electric device or apparatus.

15. The method of claim 13 wherein the step of providing means for detecting a change in motion of said electrical device or apparatus includes providing a motion detector or motion sensor attached to or proximate to said electrical device or apparatus.

16. The method of claim 13 including the step of providing a reset button to deactivate said alarm device.

17. The method of claim 13 including the step of connecting said electrical power cord of said electrical device or apparatus to said integral electrical outlet and including the step of connecting said secondary electrical power cord to said source of electrical power.

* * * * *